United States Patent [19]

Moriyama

[11] Patent Number: 4,933,726

[45] Date of Patent: Jun. 12, 1990

[54] COPY PAPER DISCHARGE ROLLERS FOR COPYING MACHINE

[75] Inventor: Koichi Moriyama, Yamatokoriyama, Japan

[73] Assignee: Sharp Kabushiki Kaisha, Osaka, Japan

[21] Appl. No.: 363,285

[22] Filed: Jun. 7, 1989

Related U.S. Application Data

[63] Continuation of Ser. No. 256,123, Oct. 6, 1988, abandoned, which is a continuation of Ser. No. 129,953, Dec. 3, 1987, abandoned, which is a continuation of Ser. No. 890,943, Jul. 31, 1986, abandoned.

[30] Foreign Application Priority Data

Aug. 28, 1985 [JP] Japan ..... 60-131791

[51] Int. Cl.[5] ..... G03G 15/00

[52] U.S. Cl. ..... 355/309; 355/289; 355/290

[58] Field of Search ..... 271/161, 209, 188, 272, 271/273, 274, 270; 355/14 SH, 14 FU, 3 SH, 14 TR, 282, 295, 309, 285, 289, 290; 219/216

[56] References Cited

U.S. PATENT DOCUMENTS

| | | | |
|---|---|---|---|
| 1,685,873 | 10/1928 | Evans et al. | 271/188 |
| 4,372,549 | 2/1983 | Stiernspetz | 271/161 |
| 4,609,276 | 9/1986 | Mitzutani | 355/309 |
| 4,717,938 | 1/1988 | Tanjo | 355/3 SH |

FOREIGN PATENT DOCUMENTS

| | | | |
|---|---|---|---|
| 52341 | 5/1981 | Japan | 271/272 |
| 53875 | 3/1984 | Japan | 355/3 SH |
| 198238 | 11/1984 | Japan | 271/272 |
| 50527 | 3/1985 | Japan | 355/3 SH |

*Primary Examiner*—R. L. Moses
*Assistant Examiner*—E. Pipala
*Attorney, Agent, or Firm*—Flehr, Hohbach, Test, Albritton & Herbert

[57] ABSTRACT

A copy paper which is passed between fixing rollers and then transported to discharge roller means to be discharged is usually in a wavy condition. This condition is corrected when this copy paper is passed between a driver roller and a follower roller which are parts of the discharge roller means and in contact and in rotary motion communicating relationship with each other such that the edge sections of the paper travels faster between them than the speed with which it passed through the fixing rollers.

10 Claims, 2 Drawing Sheets

COPY PAPER DISCHARGE ROLLERS FOR COPYING MACHINE

This is a continuation of application Ser. No. 256,123 filed Oct. 6, 1988, now abandoned, which is a continuation of application Ser. No. 129,953 filed Dec. 3, 1987, now abandoned, which is a continuation of application Ser. No. 890,943 filed July 31, 1986, now abandoned.

BACKGROUND OF THE INVENTION

This invention relates to discharge rollers for discharging copy paper out of an image forming apparatus such as a copying machine after the paper is passed between fixing rollers to have images formed on the paper fixed.

In an electrophotographic image forming apparatus such as a copying machine, a visible image (toner image) formed on a recording medium is transferred onto a sheet of image receiving paper and after this paper is transported to a fixing device to have the transferred toner image fixed, it is discharged out of the apparatus, for example, into a discharge tray. For fixing such a toner image formed on a copy paper, use is frequently made of a pair of fixing rollers which are pressed against each other, one of them being what may be referred to as a heat roller which contains a heater inside and the other, which may be referred to as a compression roller, being pressed against the heat roller with an appropriate pressure between them. The heat roller in such a pair is often designed in a so-called reverse crown shape in order to prevent the copy paper from becoming wrinkled when it passes between the heat and compression rollers. According to this design, the roller has a greater diameter at both ends than at the center (by 0.05–0.2 mm, for example) such that the paper passing between the heat and compression rollers tends to travel faster at the edges than at the center. This has the effect of stretching the paper and thereby preventing it from becoming wrinkled.

If the paper which is coming out of the fixing rollers has different speeds at the edges and at the center as explained above, however, it tends to flex unevenly between the pair of fixing rollers and the discharge rollers which are placed at downstream positions with respect to the fixing rollers to guide the paper out of the copying machine. This has the undesirable effect of forming waves in the paper a shown in FIG. 4 with respect to the direction of motion of the paper indicated by the arrow A when it is discharged. Such sheets of copy paper are difficult to sort.

FIGS. 5 and 6 show discharge rollers previously designed for eliminating the difficulties described above. According to this design, a driver roller 1 and a follower roller 2 are provided parallel and adjacent to each other in a side-by-side relationship. A sheet of copy paper 3, which comes out of a pair of fixing rollers (not shown in FIGS. 5 and 6) in a wavy condition, as explained above and illustrated in FIG. 4, is passed between the discharge rollers 1 and 2, and this tends to correct the wavy condition of the paper. In order to improve this correction effect, the distance $t_1$ indicated in FIG. 5 or $t_2$ indicated in FIG. 6 may be made smaller. If these distances are made excessively small, however, the paper 3 may become folded.

With discharge rollers shown in FIG. 5 or 6, however, the condition shown in FIG. 4 can be corrected only to a very limited extent. Corrections are far from perfect.

SUMMARY OF THE INVENTION

It is an object of this invention in view of the above to provide discharge rollers which can effectively eliminate the wavy condition of copy paper coming out of fixing rollers caused by the difference in speed at which the paper is passed between the fixing rollers at the center and at the edges.

The above and other objects of the present invention are achieved by providing, at a downstream position from a pair of fixing rollers with respect to the motion of copy paper, a pair of discharge rollers which are a driver roller and a follower roller such that when a copy paper, which passes through the fixing rollers and is transported to the discharge rollers, passes between the driver and follower rollers, the edge sections of the paper travels faster between them than the speed with which it passed through the fixing rollers.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1:
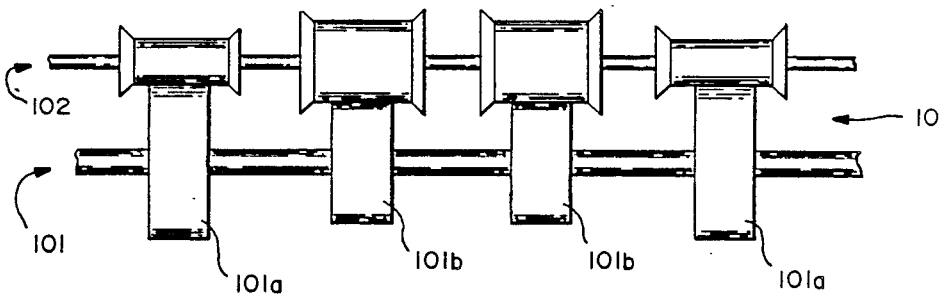
FIG. 1 is a front view of discharge rollers for copy paper according to one embodiment of the present invention.
Figure 2:
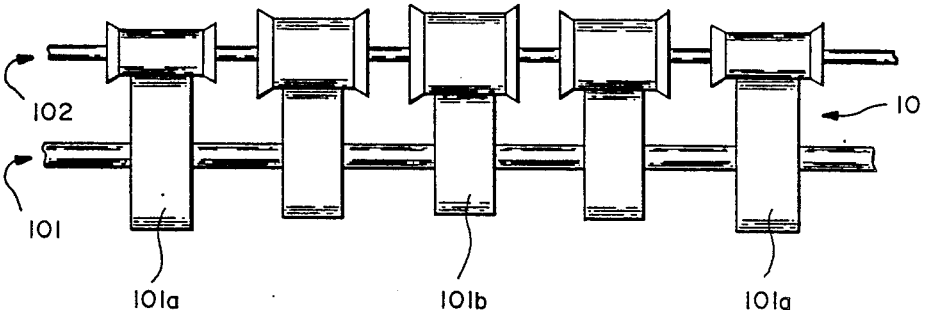
FIG. 2 is a front view of discharge rollers for copy paper according to another embodiment of the present invention.
Figure 3:
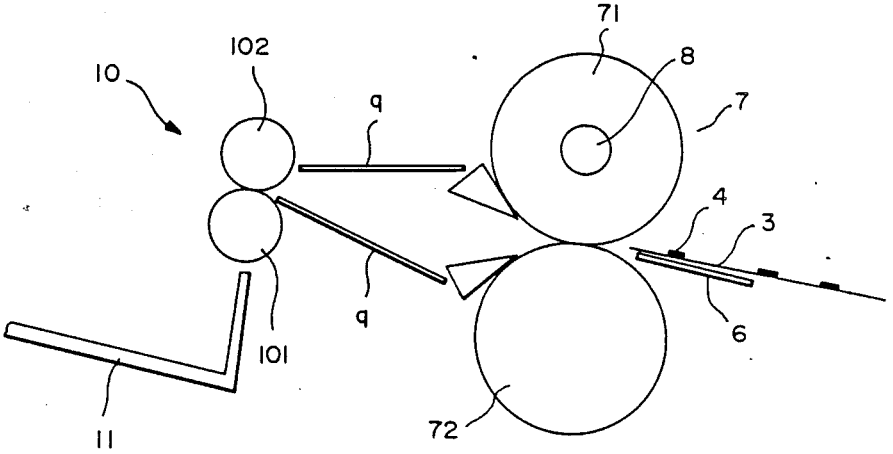
FIG. 3 is a side sectional view of a part of an image forming apparatus such as a copying machine including discharge rollers of the present invention and a pair of fixing rollers.

Discharge rollers embodying the present invention are explained by way of FIGS. 1, 2 and 3. With reference to FIG. 3, a sheet of copy paper 3 with a toner image 4 transferred thereonto is transported along a guiding plate 6 to fixing rollers 7. The fixing rollers 7 include a heat roller 71 containing a heater 8 and a compression roller 72 which is pressed against the heat roller 71 with an appropriate pressure. These rollers (and, in particular, the heat roller 71) are formed in a so-called reverse crown shape explained above. The copy paper 3, after passing through the fixing rollers station 7, is led to discharge rollers 10 by means of guide plates 9 and then discharged into a discharge tray 11. The discharge rollers 10 include a driver roller 101 and a follower roller 102, each comprising coaxially connected cylindrical pieces and each of the pieces on the driver roller 101 being in contact with a corresponding cylindrical piece on the follower roller 102. Those of the cylindrical pieces on the driver roller 101 near the edges (indicated by the numeral 101*a*) have larger diameters than those near the center (indicated by the numeral 101*b*) such that the speed of the paper at the edges is greater by 5–15% than the transport speed of the paper when it passes through the fixing rollers 7. The cylindrical pieces near the center 101*b* are so designed that the speed of the paper near the center is about the same as the transport speed of the paper when it passes through the fixing rollers 7. The follower roller 102 is formed with cylindrical pieces as shown in FIGS. 1 and 2, each contacting a corresponding cylindrical piece 101*a* or 101*b* on the driver roller 101. Each cylindrical piece on the follower roller 102 is provided with outwardly protruding pieces at the edges.

Figure 4:
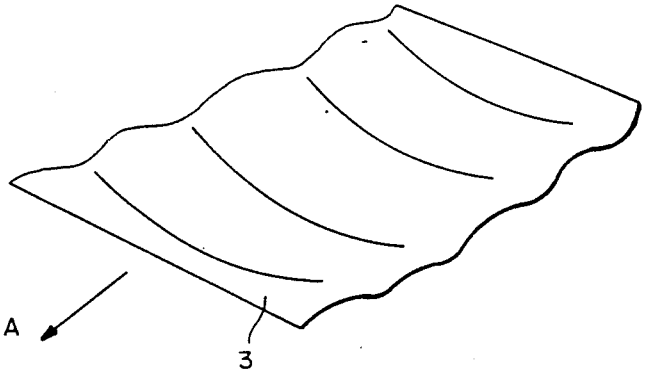
FIG. 4 is a view of a sheet of copy paper in a wavy condition after it is passed between fixing rollers.
Figure 5:
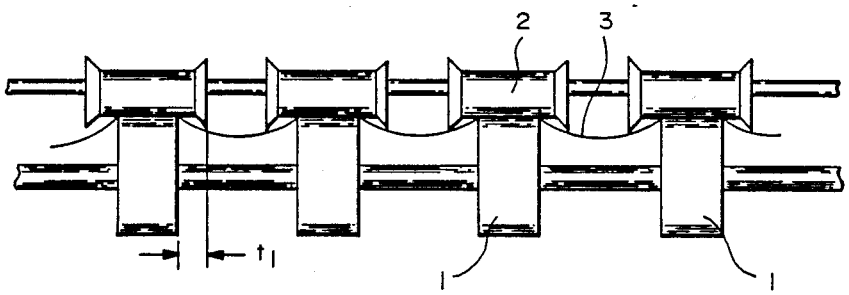
FIG.— 5 (PRIOR ART)
FIG. 5 is a front view of an example of discharge rollers previously considered.
Figure 6:
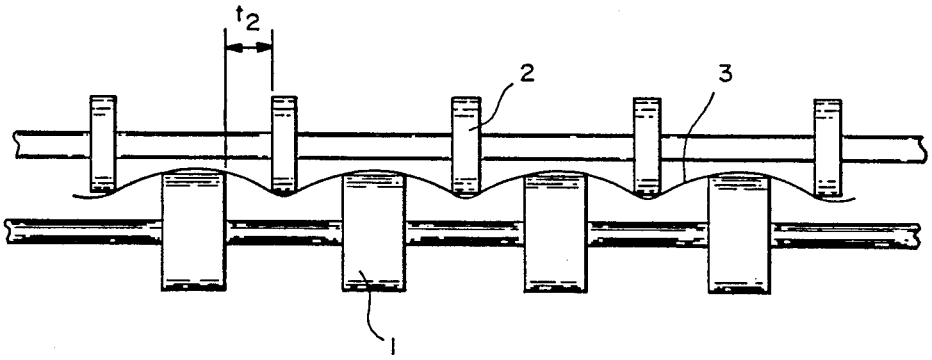
FIG.— 6 (PRIOR ART)
FIG. 6 is a front view of another example of discharge rollers previously considered.

As shown in FIG. 3, a copy paper 3 which has passed between the fixing rollers 71 and 72 is led by the guide plates 9 to the discharge rollers 10. The paper 3 is passed between the rollers 101 and 102 with both its edge sections pulled outward and is then discharged into the discharge tray 11. The waves in the paper as shown in FIG. 4 can be corrected because the paper 3 is stretched from both edges as explained above. The protrusions at the edges of the cylindrical pieces on the follower roller 102 generate waves perpendicularly to the waves shown in FIG. 4. This additionally serves to correct the waves shown in FIG. 4.

The foregoing description of preferred embodiments of the invention has been presented for purposes of illustration and description. It is not intended to be exhaustive or to limit the invention to the precise form disclosed, and obviously many modifications and variations are possible in light of the above teaching. For example, since the waves as shown in FIG. 4 appear more prominently when the copy paper is large such that the ratio between the circumferential speeds of the center and edge sections of the fixing rollers is large, the cylindrical pieces on the discharge rollers may be so arranged that only those at the edges (indicated in FIG. 1 by the numerals 101*a*) have an increased diameter. Alternatively, the diameters of the cylindrical pieces may increase gradually from the center piece 101*b* to the ones at the edges (101*a*) as shown in FIG. 2. This design is advantageous in that waves can be corrected efficiently, independent of the size of the copy paper.

In summary, since discharge rollers of the present invention are disposed at a downstream position from fixing rollers and cause the copy paper from the fixing rollers to pass therethrough faster at the edges than the speed when it passes through the fixing rollers, waves can be effectively eliminated when the paper is discharged from them. Modifications and variations of the embodiments of the present invention which may be apparent to a person skilled in the art are intended to be included within the scope of this invention.

What is claimed is:

1. In combination, discharge rollers having edge sections and a center section and fixing rollers consisting of a heat roller in a reverse crown shape and a compression roller pressed against said heat roller and being adapted to pass a copy paper sheet therebetween at a preset paper speed towards said discharge rollers, said discharge rollers being so designed that said center section passes said copy paper sheet at approximately the same speed as said preset paper speed and said edge sections pass said copy paper sheet at a faster rate than said preset paper speed.

2. The combination of claim 1 wherein speed of said copy paper sheet passing between said discharge rollers at said edge sections is greater by 5–10% than said preset paper speed.

3. The combination of claim 1 wherein said discharge rollers are so designed that only paper sheets of a certain size pass therethrough at a faster rate at said edge sections than at said center section.

4. The combination of claim 1 comprising a driver roller which is rotatable around a driver shaft and a follower roller which is rotatable around a follower shaft, said shafts being parallel to each other.

5. The combination of claim 4 wherein said driver roller and said follower roller are in contact and in rotary motion communicating relationship with each other.

6. The combination of claim 4 wherein said driver roller includes a plurality of cylindrical driver pieces which are coaxially affixed to said driver shaft in a linear array, defining end and center pieces.

7. The combination of claim 6 wherein diameters of said cylindrical driver pieces decrease from said end pieces to said center pieces.

8. The combination of claim 4 wherein said follower roller includes a plurality of cylindrical follower pieces which are coaxially affixed to said follower shaft.

9. The combination of claim 8 wherein each of said cylindrical follower pieces is opposite to one of said cylindrical driver pieces.

10. The combination of claim 8 wherein each of said cylindrical follower pieces has radially protruding pieces at edges.

* * * * *